US006029644A

United States Patent [19]

Bronnert

[11] Patent Number: 6,029,644

[45] Date of Patent: Feb. 29, 2000

[54] BOW LIMB ARTICULATION

[76] Inventor: Herve X. Bronnert, 21495 Partridge Ct., Brookfield, Wis. 53005

[21] Appl. No.: 09/172,801

[22] Filed: Oct. 14, 1998

[51] Int. Cl.[7] ..... F41B 5/10

[52] U.S. Cl. ..... 124/25.6; 124/23.1

[58] Field of Search ..... 124/23.1, 25.6, 124/86

[56] References Cited

U.S. PATENT DOCUMENTS

| | | | |
|---|---|---|---|
| 4,227,509 | 10/1980 | Jones | 124/25.6 |
| 4,287,867 | 9/1981 | Islas | 124/25.6 |
| 4,781,168 | 11/1988 | Lester | 124/25.6 |
| 4,858,588 | 8/1989 | Bozek | 124/25.6 X |
| 5,205,267 | 4/1993 | Burdick | 124/44.5 X |
| 5,388,564 | 2/1995 | Islas | 124/25.6 |
| 5,454,361 | 10/1995 | Bronnert | 124/23.1 |
| 5,499,618 | 3/1996 | Thompson | 124/25.6 |

*Primary Examiner*—John A. Ricci
*Attorney, Agent, or Firm*—Foley & Lardner

[57] ABSTRACT

A bow including a riser, a support member mounted on each end of the riser, and a pair of limbs. Each limb is operatively connected to the riser and support member with a reed assembly including a spring strip.

20 Claims, 11 Drawing Sheets

FIG. 5
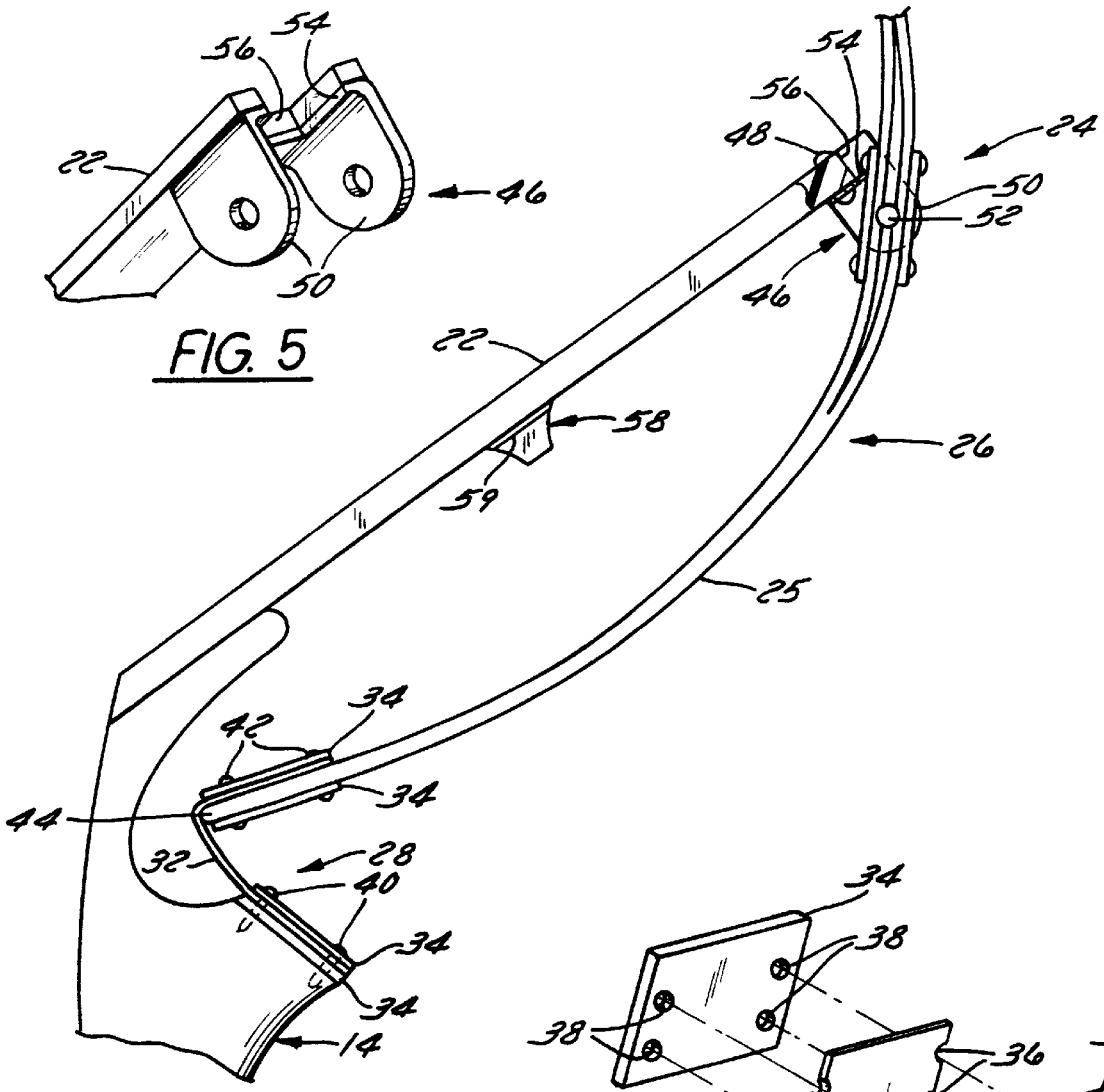
FIG. 3
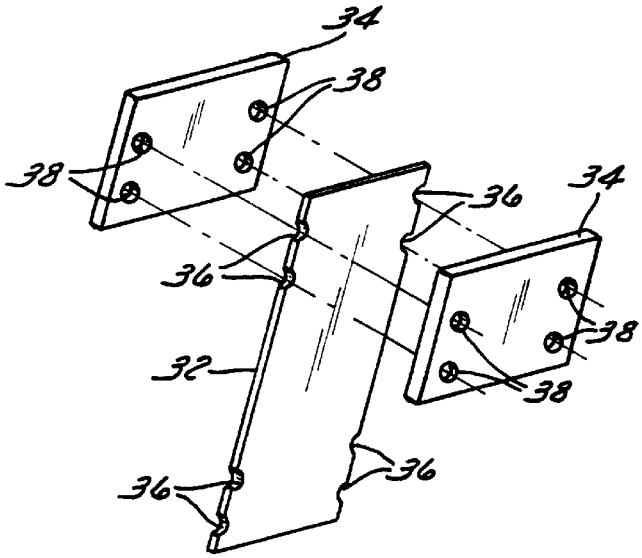
FIG. 4

8
8
64A
64B
66B
66A 64A
64B
66B
66A 64A
64B
60
66B
66A 64
66
9
9
60
52
62
10
10
25
11
11
12
12

60
52
62
26
25

64A
64B
66B
66A 64A
64B
66B
66A

BOW LIMB ARTICULATION

FIELD OF THE INVENTION

The present invention relates to a bow including a riser having a support member on each end, a limb is mounted to the riser with a reed assembly.

BACKGROUND OF THE INVENTION

In my earlier U.S. Pat. No. 5,454,361, issued on Oct. 3, 1995, entitled "Sequential Bow," the bow included a hand held riser having a limb pivotally mounted on each end of the riser. Each limb including an inner section, an intermediate section and an outer section of different degrees of flexibility. A support member is mounted on each end of the risers in a position to engage the intermediate section of each of the limbs. A bow string is attached to the outer ends of the limbs so that the outer section of the limbs will be drawn together rearwardly of the support members to form a recurve in the inner section of the limb.

SUMMARY OF THE PRESENT INVENTION

In accordance with the present invention the bow includes a hand held riser, and a pair of bottom reed assemblies attached proximate to respective ends of the riser. The bow further includes a pair of limbs operatively connected to the bow with a respective reed assembly.

In another aspect of the invention the bow includes a riser and a pair of support members mounted to and angularly offset from the riser. A pair of limbs are operatively connected to each support members with a respective upper reed assembly.

In still another aspect of the invention, a bow generally includes a riser having an angularly offset support member mounted on each end of the riser and a laminated limb pivotally mounted on the end of the support member intermediate the end of the limb. More particularly a pivot bracket is mounted on the end of each of the support members for pivotally supporting a laminated limb. One end of each limb is connected to the riser by a reed assembly which allows for angular and linear motion to take place without friction when holding the limbs against 100–200 pounds depending on the bow weight, with 40–70 pounds draw force. Adjustable stops may be provided on the support members to adjust the motion of the lower portion of the limbs to vary the draw force.

Other principal features and advantages of the invention will become apparent to those skilled in the art upon review of the following drawings, the detailed description and the appended claims.

BRIEF DESCRIPTION OF THE DRAWINGS

FIG. 3 is a view of the connections of the bow to the riser and the pivotal connection of the bow to the support member;

FIG. 4 is an exploded view of the reed connection to the riser and the limb;

FIG. 5 is a perspective view of the pivot assembly for connecting the limb to the support member;

Figure 1:
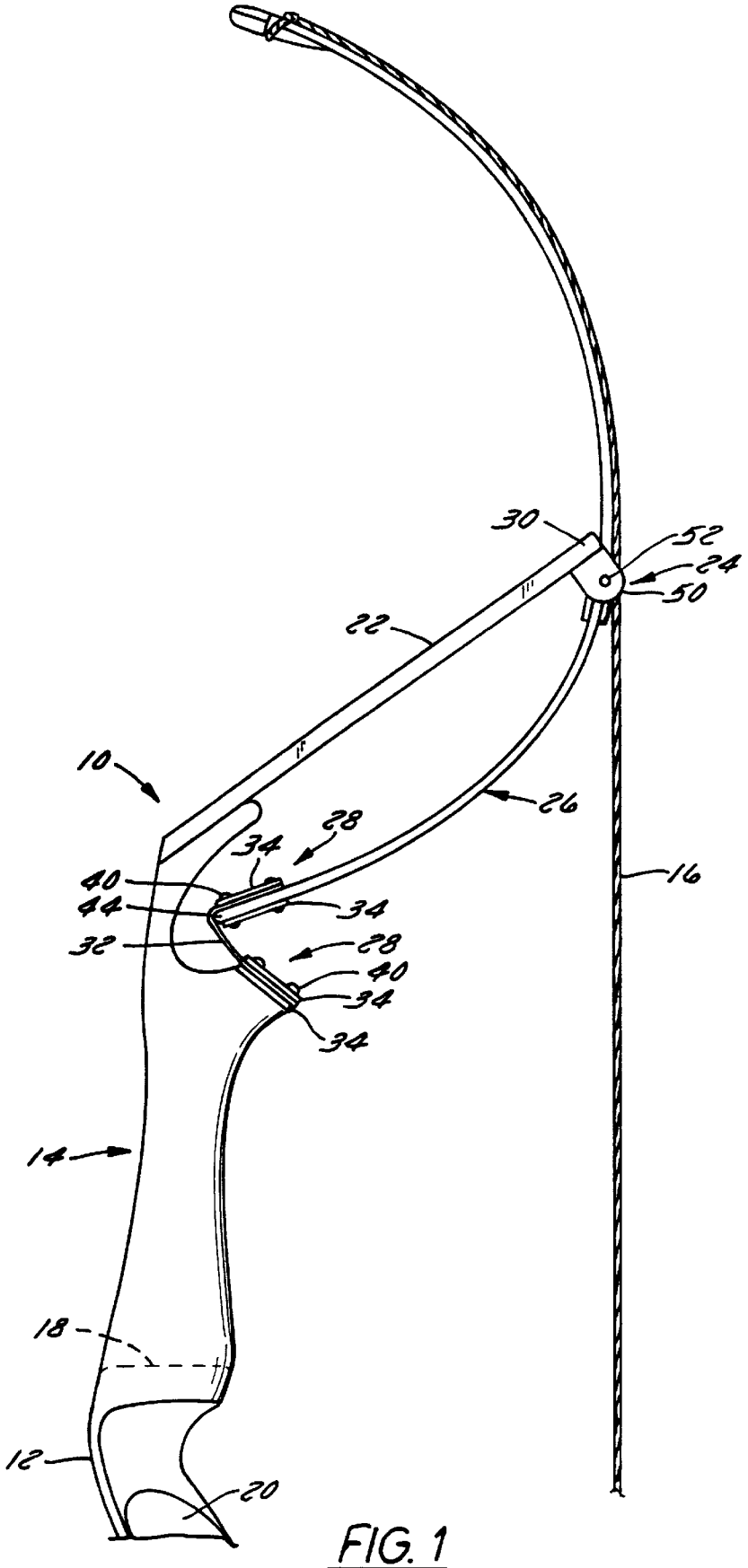
FIG. 1 is a side view of the upper half of the bow according to the present invention.

Before explaining the embodiments of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
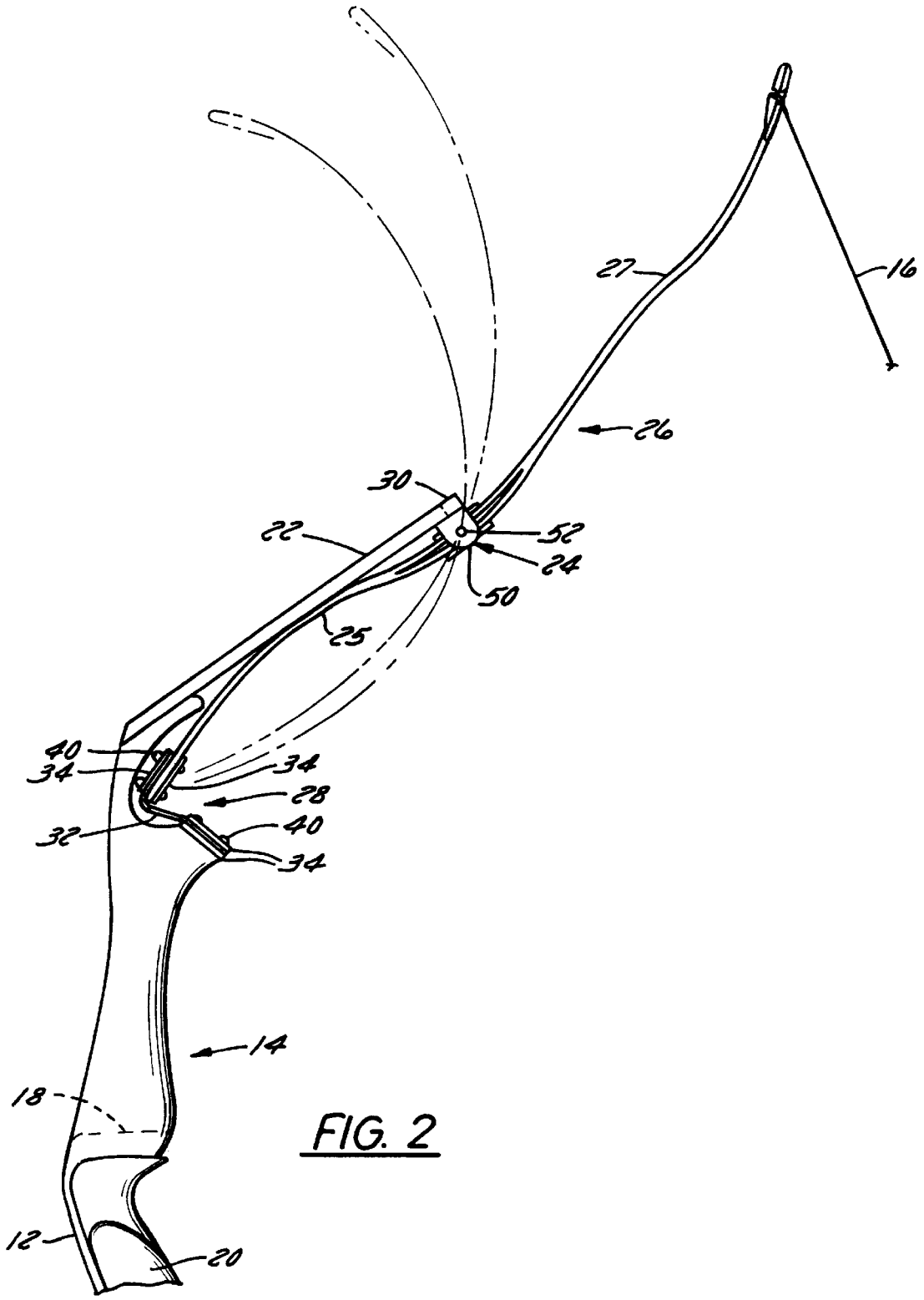
FIG. 2 is a view similar to FIG. 1 showing the limb in the drawn position.

In operation the bow 10 is held by grasping the handle portion 12 of the riser 14, seating an arrow (not shown) on the bowstring 16 with the arrow aligned with an arrow rest 18 on the riser 14. The arrow is then drawn back to the last position shown in FIG. 2 and released when aligned with the target.

More particularly the riser 14 includes a handle section 20 intermediate the ends thereof. A support member 22 is mounted on each end of the riser 14 each of which angle rearwardly and outwardly from the riser 14. A bearing assembly 24 is provided at the outer end 30 of each of the support members 22. A limb 26 is pivotally connected to each of the bearing assemblies 24 with the inner ends connected to the riser by a reed assembly 28.

The reed assembly 28 as shown in FIGS. 3 and 4 operatively connects the inner end 44 of the limb 26 to the riser 12. The reed assembly includes a rectangular reed 32 of carbon steel, such as blue tempered and polished spring steel, having a pair of plates 34 aligned with each end of the reed 32. A pair of notches 36 are provided on each side of each end of the reed 32. Each plate 34 is provided with a pair of holes 38 on each side which are aligned with the notches 36. Screws 40 or bolts 42 are aligned with each hole 38 in the plates and each notch 36 in the reed 32. One end of the reed 32 is secured to the riser 14 by the screws 40. The other end of the reed 32 is aligned with the inner end 44 of the limb and secured thereto by plates 34 and bolts 42.

It should be noted that the reed 32 is bent with a small radius at an angle of approximately 90° to match the limb end 44. With this arrangement the inner end 44 of the limb can move linearly and at the same time angularly without any friction to the limb's motion. In addition to the angular and lateral motions, the reed assembly 28 positively guides the inner end 44 of the limb against twisting. These two points of positive guiding improve the anti-twisting resistance of the limb's upper extension.

The bearing assembly 24 which is mounted on the outer end of the support member 22 pivotally supports the limb 26. In this regard and referring to FIGS. 3 and 5 the bearing assembly 24 includes a bracket 46 mounted on the outer end of the limb 22 by a nut and bolt assembly 48. A pair of ears 50 are formed on each end of the bracket 46 for supporting a pivot pin 52. A notch 54 is provided in the bracket 46 in alignment with a notch 56 in the limb to provide sufficient clearance to pivot the limb 26 on the pivot pin.

The support member 22 may act to stop the pivotal motion of the lower half 25 of the limb 26 in order to positively sequence the limb's different working sections. In this regard means 58 can be positioned on the support member 22 to limit the pivotal motion of the lower limb section 25. Such means can be in the form of a number of shims 59 or a screw which could be adjusted to limit the motion of the limb section 25 in order to positively sequence the limb's different working sections. Of course bow 10 may be configured such that support member 22 does not interfere with limb 26.

Contrasted with existing limbs found on a recurve or compound bow, the location of the pivot assembly 24 necessitates an increased cross section tapered limb 26 with the maximum cross section located at the pivot point of the bearing assembly 24. This diminution of the two limbs' cross section can be achieved in different ways. For example, by using hard maple wood laminations 64 and 66 as shown in FIGS. 6 through 12. Other materials such as fiberglass, carbon fiber, metals or other suitable materials be utilized in the lamination. Each of the lamination sets could be tapered with the two tapered laminations assembled back-to-back.

Figures 6, 7, 8, 9, 10, 11, 12:
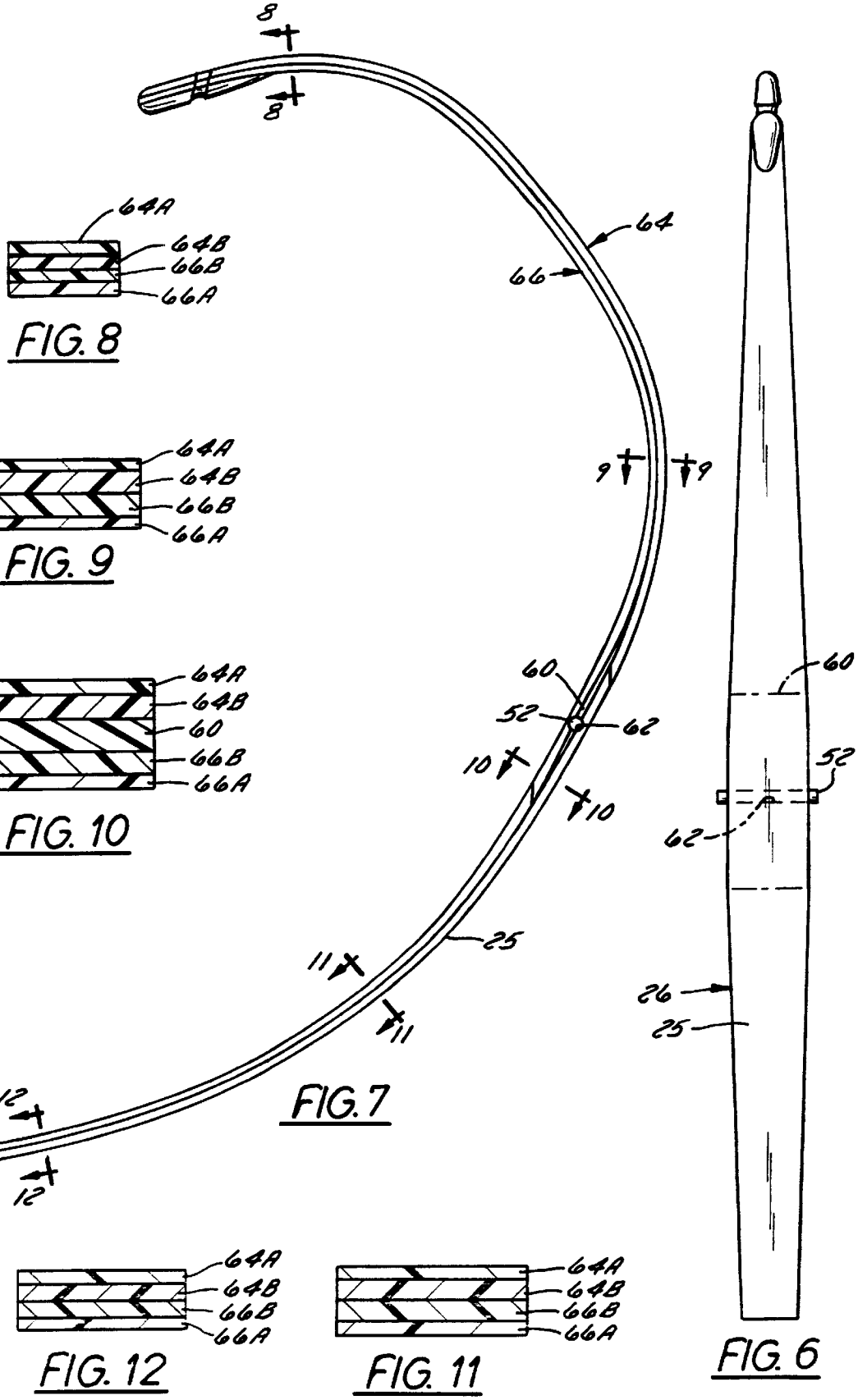
FIG. 6 is a front view of the limb.
FIG. 7 is a side view of the limb.
FIG. 8 is a cross section view of the limb taken on line 8—8.
FIG. 9 is a view taken on line 9—9.
FIG. 10 is a view taken on line 10—10.
FIG. 11 is a view taken on line 11—11.
FIG. 12 is a view taken on line 12—12.

In this regard and referring to FIGS. 6, 7 and 10, each lamination 64 and 66 is formed with outer laminations 64A and 66A and inner laminations 64B and 66B. The outer laminations 64A and 66B have a constant thickness from end to end. The inner laminations 64B and 66B have thicknesses which vary progressively to the center of the limb. The two laminations 64 and 66 being interconnected from end to end with a tapered phenolic center piece 60 positioned between the laminations 64 and 66 with the pivot pin 52 aligned with a hole 62 in the center piece 60.

Referring to FIGS. 8 through 12 cross sections are shown of the progressive change of the inner thickness of the laminations 64B and 66B. FIGS. 8 through 12 show cross sections of the limbs wherein the outer laminations 64A and 66A are of a constant thickness and the inner laminations 64B and 66B increase in thickness from the outer ends to the center of the limb. In FIG. 8 the thickness of the laminations 64B is 0.035 and 66B is 0.035. In FIG. 9 the lamination 64B is 0.055 and 66B is 0.055. In FIG. 10 the cross section 64B is 0.065 and 66B is 0.065. The phenolic insert 60 has a cross section of 0.090 at the center. In FIG. 11 the cross section 64B is 0.059 and 66B is 0.059. In FIG. 12 the cross section 64B is 0.045 and 66B 0.045. The center lamination 60 has a thickness 0.090 at the center and tapers outwardly from the center of the bow.

Further, it is possible to employ an additional bracket (not shown) which would be attached to the outer portion of the limb to receive the pivot. In this manner the limb need not require additional thickness at the pivot point.

In an alternative embodiment the limb may be formed with parallel laminations of consistent thicknesses which change continuously in width. Whichever method is used the reduction of cross section on the two end parts of both limbs is used to generate an even distribution of the limb's stress and degree of flexibility.

Figure 13:
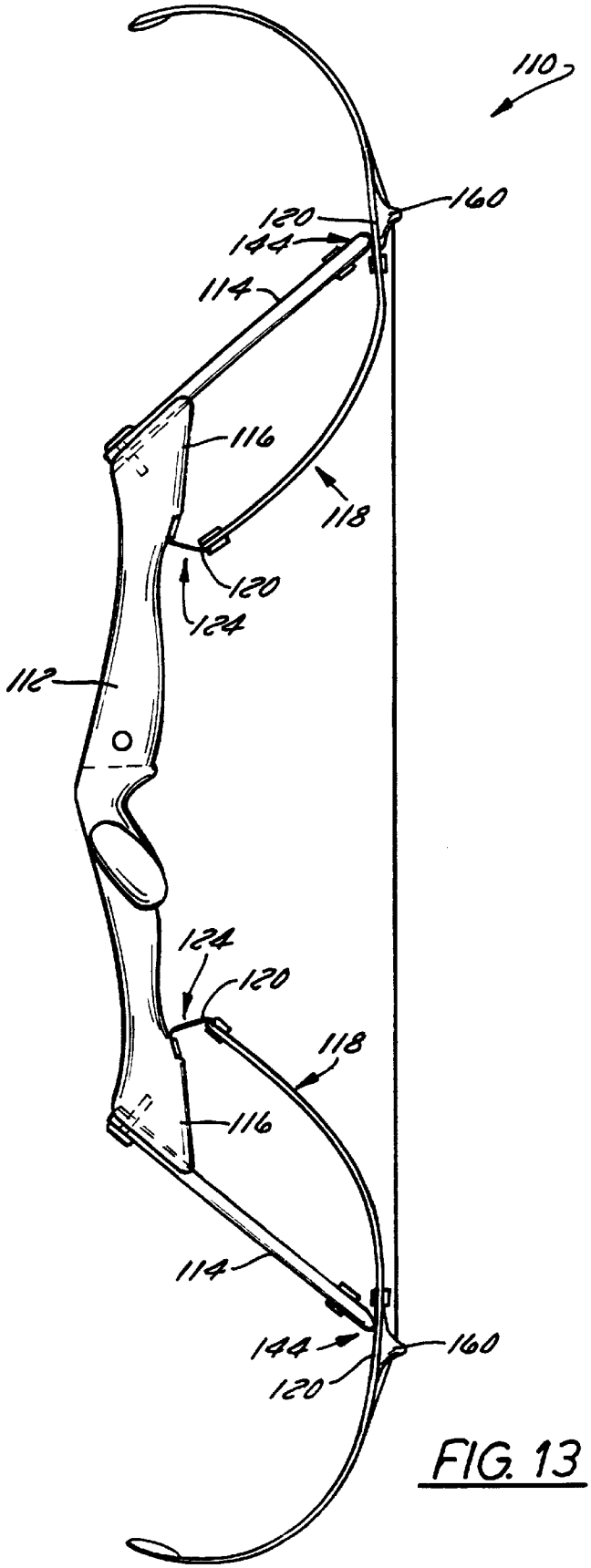
FIG. 13 is a side view of a second embodiment of a bow with a dual reed assembly.

In another embodiment illustrated in FIG. 13, a bow 110 includes a riser 112. Bow 110 further includes a pair of support members 114 mounted on each end 116 of the riser 112 respectively. Each support member 114 is angled rearwardly and outwardly from the riser 112. Bow 110 also includes a pair of limbs 118 each having a bottom end 120 secured proximate a respective end 116 of the riser 112, and a middle portion 122 secured to a respective outer end of the support member 114.

Figure 14:
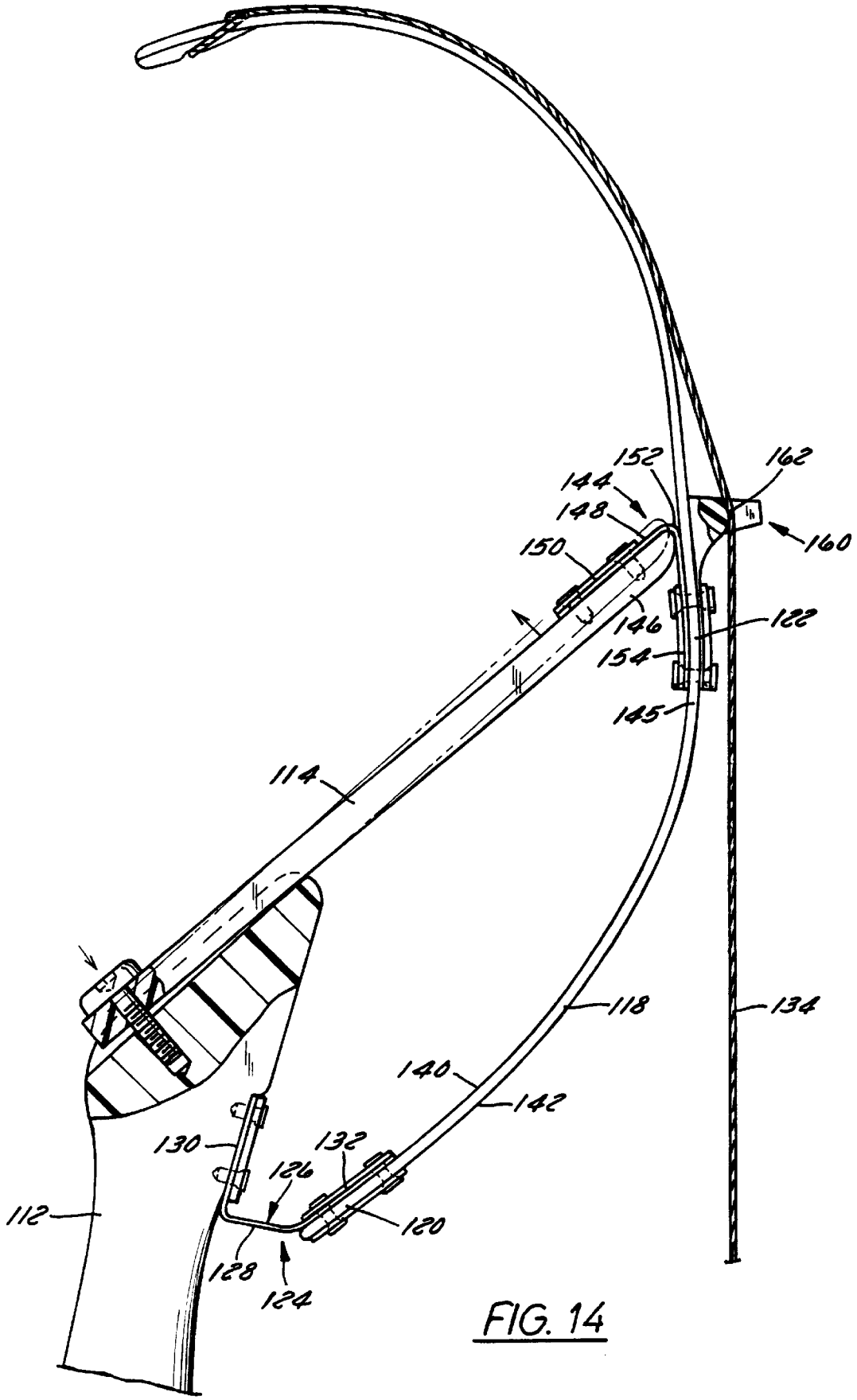
FIG. 14 is a side view of the upper half of the bow according to the second embodiment.

As in the embodiment discussed above, the bottom end 120 of each limb 118 is secured to the riser 112 with a bottom reed assembly 124. As illustrated in FIGS. 13 and 14 each bottom assembly reed 124 includes a spring strip 126 having a central portion 128, a first end 130 secured to the riser 112 and a second end 132 secured to the bottom end 120 of the limb 118. In this embodiment, second end 132 extends rearward from the riser toward the bowstring 134, this is in contrast to the embodiment illustrated in FIGS. 1 and 2. The spring strip 126 may be reinforced as illustrated in FIG. 15 and detailed below.

Figure 15:
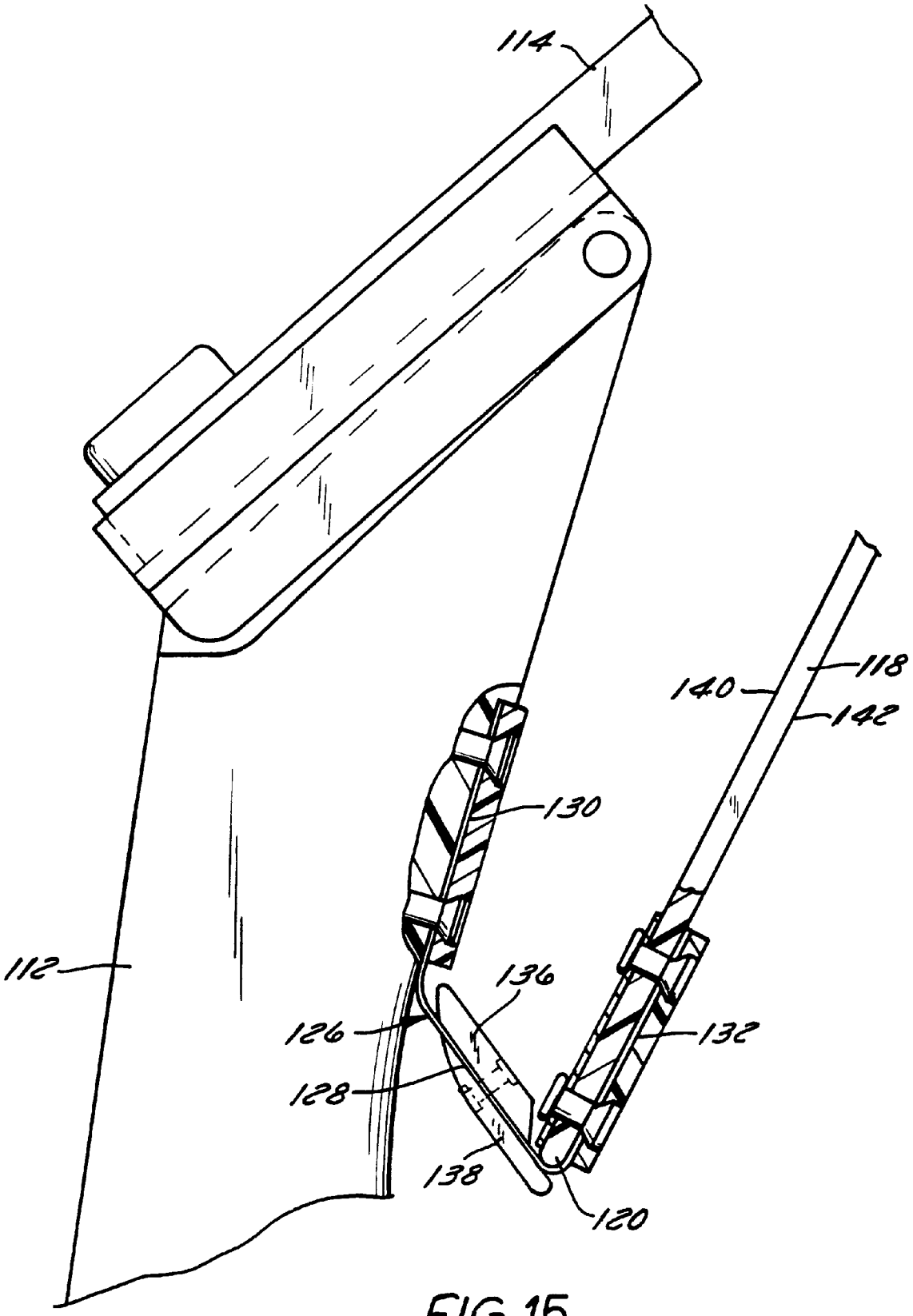
FIG. 15 is a side view of a reed assembly including two metal stiffeners.

As illustrated in FIG. 15, a top and bottom metal stiffener 136, 138 may be located on either side of the central portion 128 of the spring strip 126 to provide increased rigidity as well as to prevent any buckling of the spring strip 126 during operation of the bow. Bottom spring strip 126 may be formed of stainless steel or some other suitable material. Similarly, the stiffeners 136, 138 may also be formed of other suitable materials.

Figure 16:
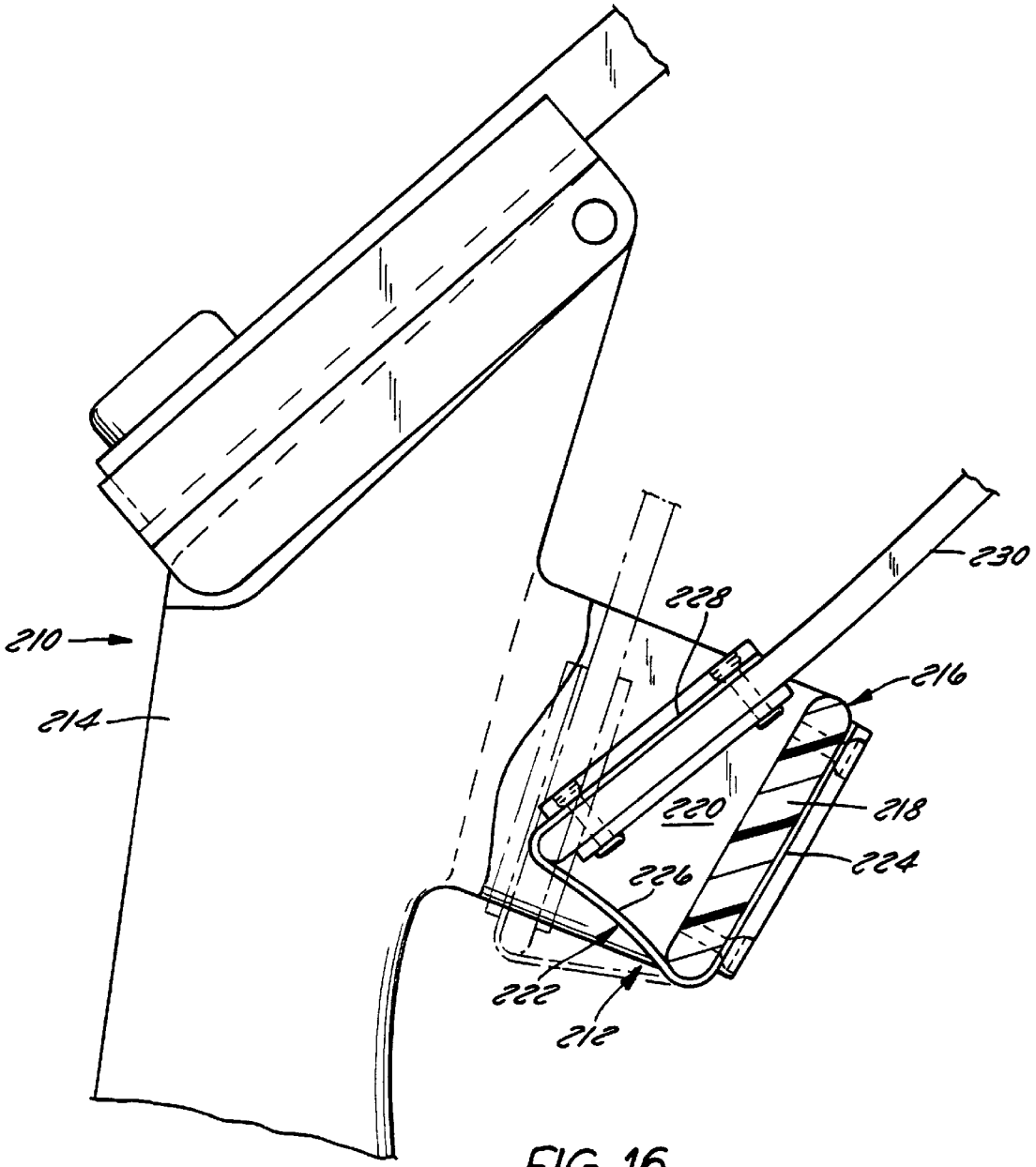
FIG. 16 is a further alternative embodiment of a bottom extension reed assembly without a need for a stiffener.

As illustrated in FIG. 14, the bottom spring strip 126 may be attached to the inner surface 140 of limb 118. However, as illustrated in FIG. 16 it is also possible to attach the spring strip 126 to the outer surface 142 of limb 118. Where the spring strip 126 is attached to the outer surface 142 of the limb 118 there is the potential that the bottom end 120 of the limb 118 will interfere with the top stiffener 136 attached to the spring strip 126. Accordingly, in this embodiment, the top stiffener 136 is offset a set distance from the bottom end 120 of the limb 118 to ensure clearance between the bottom end of the limb and the top stiffener when the bow is fully drawn.

The bottom reed assembly 124 illustrated in FIG. 13 is a compression reed such that when the bow is in its fully drawn position, the reed is compressed. This is in contrast to the reed assembly illustrated in FIG. 1 and 2 in which the reed assembly is under tension when the bow is fully drawn.

In a further embodiment, illustrated in FIG. 16, a bow 210 employs an extension reed assembly 212. In this embodiment bow 210 includes a riser 214 having an extension member 216 extending away from the riser toward the bowstring. A ledge 218 extends from the extension member 216 thereby forming a cavity 220 between the ledge 218 and the riser 214. In this embodiment a spring strip 222 includes a first section 224 secured to the ledge 218, a central portion 226 extending away from the ledge 218 toward the riser 214, and a second portion 228 secured to the limb 230. In this manner, the limb 230 is located intermediate the ledge 218 and the riser 214. When the bowstring is fully drawn, as illustrated in dashed lines in FIG. 16, the limb 230 moves away from the ledge 218 and towards the riser 214.

Referring back to FIGS. 13 and 14, an upper reed assembly 144 is secured to the middle section 145 of each limb 120 and to the upper portion 146 of each support member 114. Upper reed assembly 144 includes a spring strip 148 having a first end 150 secured to the ends 146 of the respective support member 114, a central portion 152, and a second end 154 secured to the central region 122 of the respective limb 118.

Figure 17:
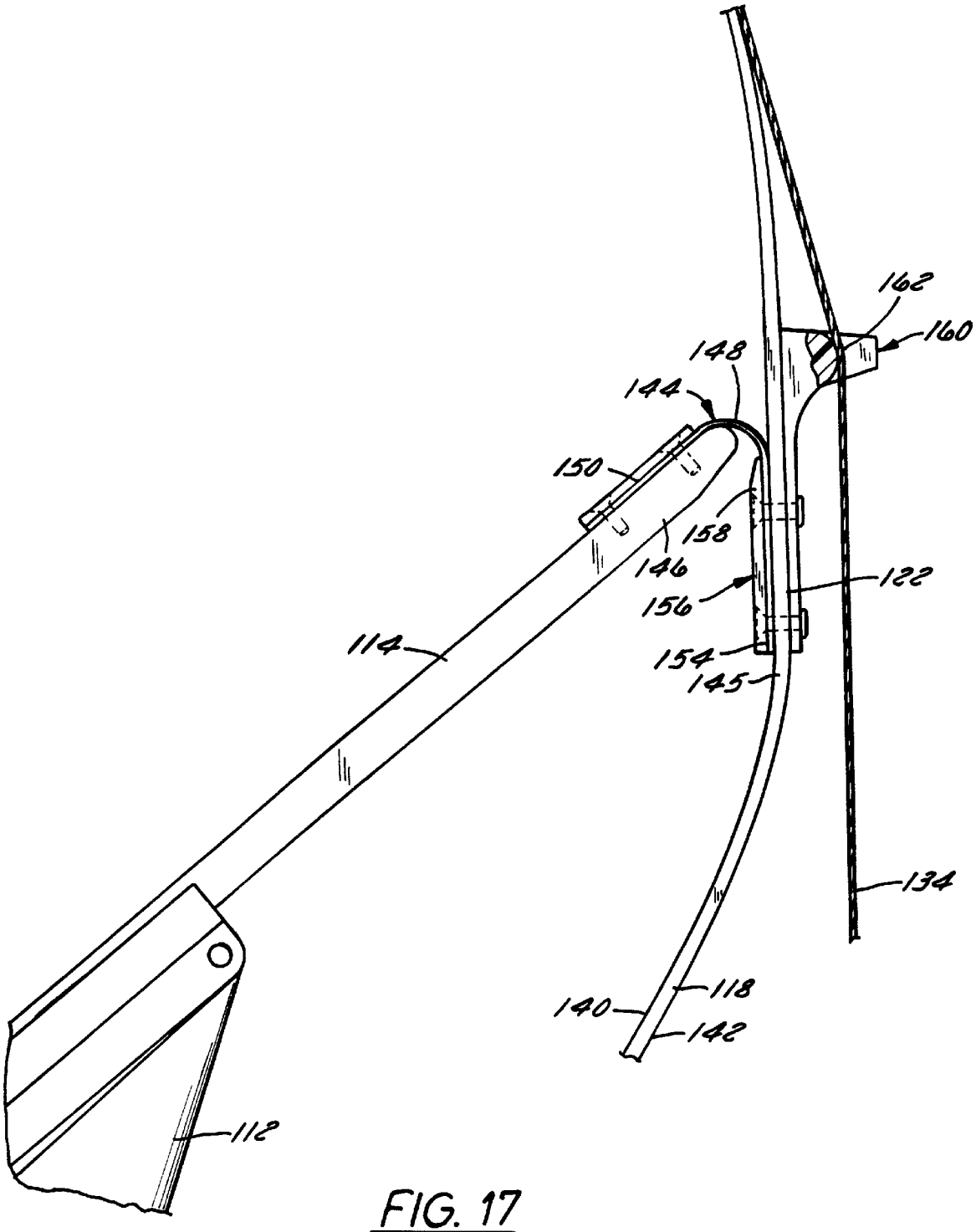
FIG. 17 is a side view of the upper reed assembly with a reed support bracket in the brace height position.
Figure 18:
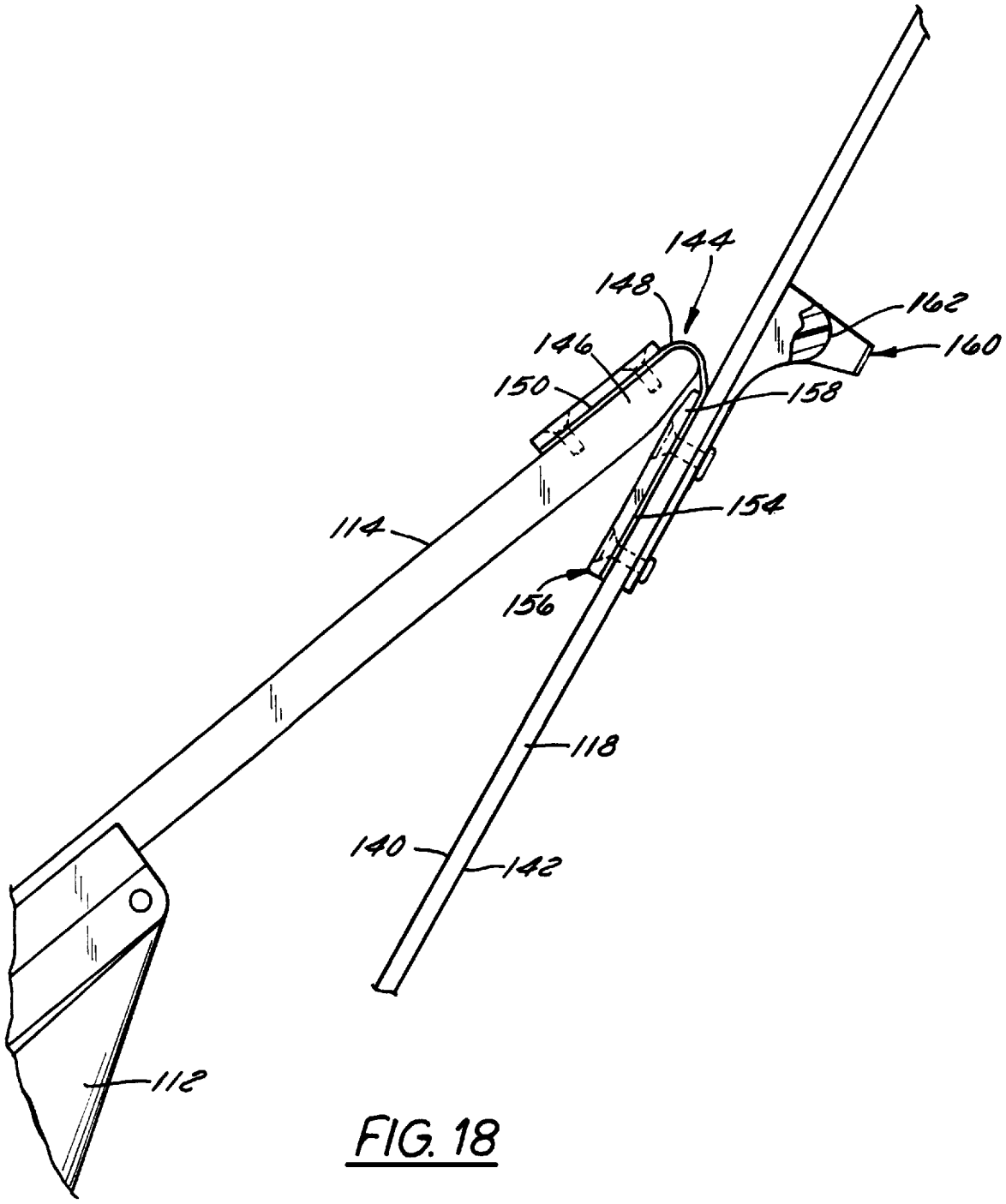
FIG. 18 is a side view of the upper reed assembly of FIG. 17 in the full draw position.

In order to further enhance the rigidity and guidance of the reed assembly, an upper support bracket 156 may be secured to upper reed assembly 144. As illustrated in FIGS. 17 and 18, upper support bracket 156 acts to keep limb 118 tight against support member 114 at the point of rotation when the bowstring 134 is fully drawn. Upper support bracket 156 is secured to the limb 118 and includes an upper portion 158 configured to support the upper spring strip 148 proximate the end 146 of support member 114 when the bow is fully drawn. (See FIG. 18). In this manner, the upper spring strip 148 is supported during draw of the bow thereby minimizing free unwanted movement of the limb 118 during its rotation.

Figure 19:
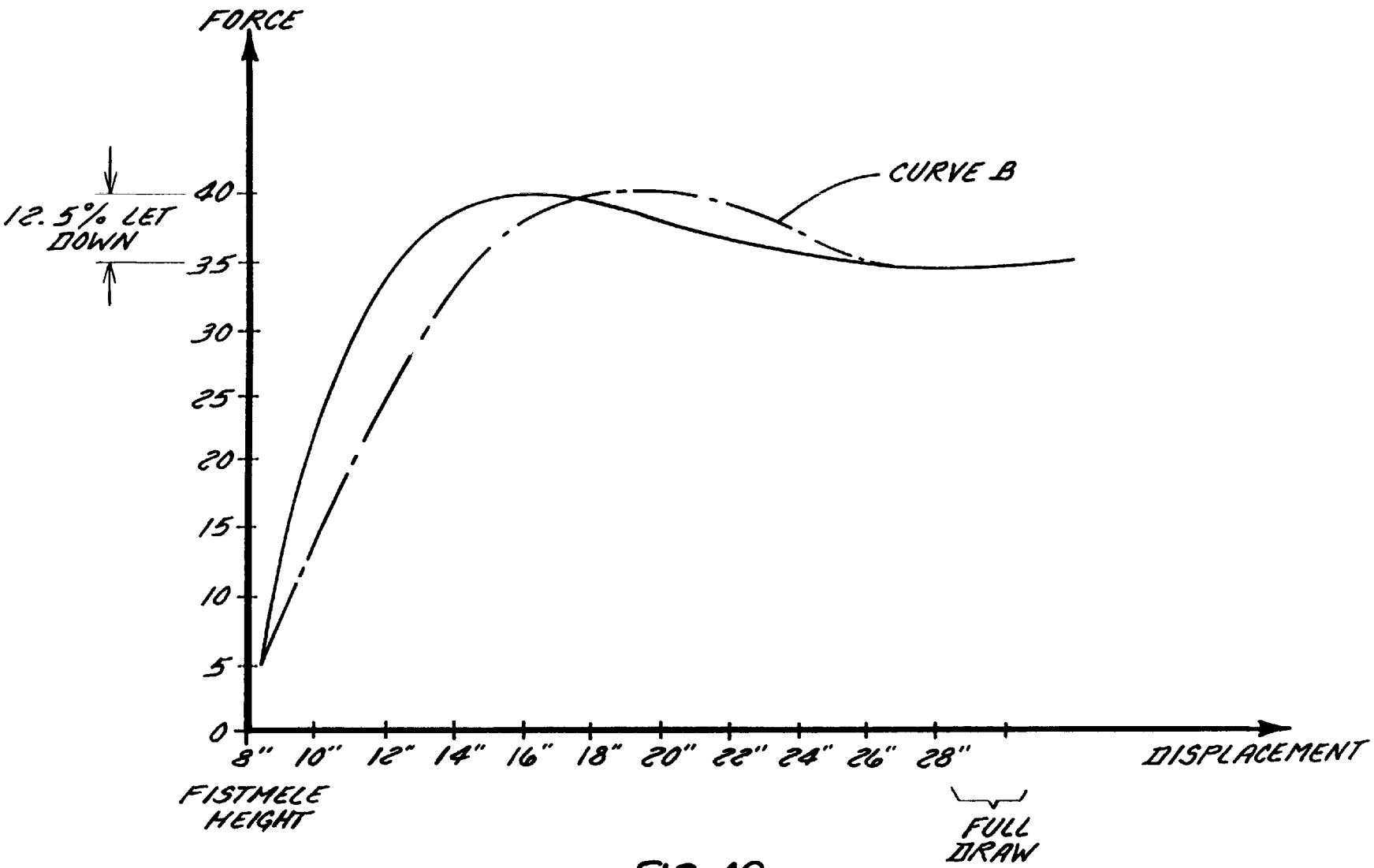
FIG. 19 is a table illustrating let down as a function of the force verses displacement.

Additionally as illustrated in FIGS. 14 and 17 a string guide 160 having a v-shaped groove 162 is located proximate the upper reed assembly 144 to guide the bowstring 134 during the draw and release of the bowstring 134. The string guide 160 distances the bowstring 134 from the limb 118 which changes the string action on the limb 118. The offset allows for an increase in the initial drawback force per unit displacement of the bowstring 134. FIG. 19 illustrates that the maximum drawback force is achieved in less displacement of the bowstring when string guide 160 is employed. In addition to achieving the maximum drawback force earlier with the use of the string guide 160, the let down of drawback force is also achieved earlier. Curve A represents the drawback force per displacement of the bowstring with the use of the string guide 160. Curve B represents the drawback force per displacement for the same bow without the use of a string guide.

Thus, it should be apparent that there has been provided in accordance with the present invention a bow limb articulation that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A bow comprising:

a riser;

a support member mounted on each end of the riser;

a pivot assembly mounted on the outer end of each support member;

a pair of limbs, each limb being connected to the end of the riser and to the outer end of each respective support member; and a reed assembly operatively connecting an inner end of each of the limbs to the riser and a bow string connected to the outer ends of the limbs whereby a recurve is introduced into the inner ends of the limbs when the limb's outer ends are drawn rearwardly of the support members.

2. The bow according to claim 1 wherein each limb includes a pair of laminated sections with the maximum cross section located at the pivot point.

3. The bow according to claim 2 wherein each lamination assembly includes an outer lamination of constant thickness and an inner lamination having a thickness which increases from the outer ends toward the center of the bow.

4. The bow according to claim 2 wherein each lamination has a width which increases from the outer ends to the center of the bow.

5. The bow according to claim 1 wherein each limb includes a pair of laminations assembled back-to-back and a spacer insert positioned between the laminations intermediate the ends thereof for supporting the limbs on the pivot assembly.

6. The bow according to claim 1 wherein said reed assemblies operatively connect the inner ends of each of the limbs a right angle which allows guiding for angular and linear motion without friction.

7. A bow comprising:

a riser;

a pair of limbs, each limb having opposing ends, and a center portion intermediate the ends, each limb being operatively connected to the riser at the respective center portion and at one of the ends;

wherein at least one of the center portion and the ends are operatively connected to the riser with a reed assembly.

8. The bow according to claim 7 wherein the riser includes an extension member having a ledge extending therefrom defining a cavity between the ledge and riser, the reed assembly including a spring strip having a first end attached to the extension member proximate the ledge, the spring strip having a second end distal the first end attached to the limb such that a portion of the limb is located in the cavity.

9. The bow according to claim 7 wherein the reed assembly includes a spring strip.

10. The bow according to claim 9 further including:

a pair of support members, each support member having a first end secured to one end of the riser, and a second distal end; and the at least one reed assembly including an upper reed assembly, the upper reed assembly operatively connecting the center portion of the limb to the second distal end of the support member.

11. The bow according to claim 10 wherein the at least one reed assembly further includes a bottom reed assembly having a spring strip secured to the riser and one end of the limb such that the spring strip is in compression when the bow is fully drawn.

12. The bow according to claim 10 further including a bowstring and a bowstring support located on the limb proximate the reed assembly member to offset the bowstring from the limb and to guide the bowstring during operation of the bow.

13. The bow according to claim 12 wherein the bowstring support is v-shaped.

14. The bow according to claim 9 wherein the spring strip includes a central region intermediate the limb and the riser, the bow further including a stiffener attached to the central region of the spring strip.

15. The bow according to claim 9 wherein the limb includes an inner surface facing the riser and an outer surface opposite thereto, the spring strip including a first end attached to the riser and a second end attached to the inner surface of the limb.

16. A bow comprising:

a hand held riser having opposite ends;

a pair of support members, each support member having a first end, and a second end, each first end of the support members extending from the respective ends of the riser;

a pair of limbs, each limb having a first end operatively connected proximate a respective end of the riser; and a pair of upper reed assemblies, each reed assembly operatively connecting each respective limb to the respective second ends of the support members.

17. The bow according to claim 16 wherein each upper reed assembly includes a spring strip having a first end attached to the support member, and a second end attached to the limb, each upper reed assembly including a guide support secured to a center portion of the spring strip intermediate the first end and the second end and adapted to guide the spring strip about the support member during operation of the bow.

18. The bow according to claim 17 wherein the guide support includes a curved portion adapted to mate with an end of the support.

19. The bow according to claim 18 further including a bowstring and a bowstring support located on the limb proimate the upper reed assembly member to offset the bowstring from the limb and to guide the bowstring during operation of the bow.

20. The bow according to claim 19 wherein the bowstring support is v-shaped.

* * * * *